United States Patent [19]

Meyers

[11] 4,060,346

[45] Nov. 29, 1977

[54] DISHWASHER MOTOR/PUMP MOUNTING MEANS

[75] Inventor: Theodore F. Meyers, Troy, Ohio

[73] Assignee: Hobart Corporation, Troy, Ohio

[21] Appl. No.: 708,927

[22] Filed: July 27, 1976

[51] Int. Cl.[2] ..... F04B 17/00; F04B 35/00

[52] U.S. Cl. ..... 417/360; 417/363; 134/188; 277/32; 285/159

[58] Field of Search ..... 417/360, 363, 424; 134/176, 186, 188; 277/12, 32, 98; 24/250 R, 258; 285/159, 312, 320; 192/89 A

[56] References Cited

U.S. PATENT DOCUMENTS

| | | | |
|---|---|---|---|
| 2,695,747 | 11/1954 | Miller | 415/201 |
| 2,877,778 | 3/1959 | Kirby | 134/186 |
| 3,425,355 | 2/1969 | La Flame et al. | 417/424 |
| 3,583,835 | 6/1971 | Coburn et al. | 417/360 |
| 3,934,688 | 1/1976 | Sides et al. | 192/89 A |

*Primary Examiner*—William L. Freeh
*Assistant Examiner*—Thomas I. Ross

[57] ABSTRACT

The motor/pump assembly for a dishwasher is inserted into the dishwasher tank and then into an opening in the tank bottom until a gasketed flange on the assembly seats on the edge of the opening. Wire springs are then hooked onto the assembly beneath the tank, and toggles thereon are rotated to cam and tension the springs to apply a predetermined, substantially constant force between the tank and the motor/pump assembly.

12 Claims, 6 Drawing Figures

DISHWASHER MOTOR/PUMP MOUNTING MEANS

BACKGROUND OF THE INVENTION

This invention relates to dishwasher machines, and more particularly to a method and apparatus for assembling and securing a motor/pump assembly into a dishwashing machine.

Domestic dishwashing machines are customarily rather compact to save space within the kitchen. This sometimes requires placing components such as the motor and/or pump in positions not readily accessible through the front of the dishwasher. Since an increasing number of dishwashers are installed within kitchen cabinetry (the so-called "built-in" dishwasher), it can be difficult, time consuming, and expensive to service such a dishwasher.

Dishwashers have therefore been designed in which all major parts are accessible from the front. Many such designs, however, still require insertion and removal of one or more major components (such as the motor or pump) from beneath the tank. This requires removing a panel beneath the door to gain access, and then the work must be done in the very cramped space beneath the dishwasher tank. In some cases therefore, even though the component may be accessible through the front of the dishwasher, practical necessity requires that the dishwasher be partially or completely removed from the kitchen cabinet for servicing.

A number of dishwashers have therefore been provided with vertically aligned motor/pump assemblies which can be inserted vertically downwardly from within the dishwasher tank through an opening therefor in the tank bottom. If servicing is then required, these components can be easily removed from the dishwasher by releasing them and then lifting them vertically through the opening into the tank, and then out of the dishwasher. U.S. Pat. No. 3,406,637 (Perl, issued Oct. 22, 1968) shows a motor/pump assembly inserted in this fashion and then secured in conventional manner by screws which fasten the assembly onto a sealing gasket on the rim of the opening in the tank bottom.

Designs such as Perl, however, still have several disadvantages. Assembly by means of screws is time consuming. Further, plastic and rubber materials exhibit flow properties over long periods of time, and rubber materials tend to deteriorate and lose their resiliency. Since higher quality dishwashers are designed for decades of service life, the sealing and clamping force initially provided by the screws can be lost by creeping, flowing and aging of plastic and/or rubber materials over this time. Screw clamp systems, therefore, even when initially properly adjusted, may not provide satisfactory sealing over long periods of time. Furthermore, assembly requires relatively large amounts of time for inserting and tightening the screws, and a degree of care and skill in tightening to the proper tension.

U.S. Pat. No. 3,603,696 (Lampman, issued Sept. 7, 1971) shows a device which overcomes several of the above limitations. The motor/pump assembly in the Lampman dishwasher is also inserted from above into a bottom opening in the tank. Then, a group of resilient retainers are rotated from inwardly directed to outwardly directed positions to engage the underside of the edge of the opening to secure the assembly therein. Here again, however, there is no affirmative provision for securing the motor/pump assembly within the opening with a substantially constant, downward force to provide an adequate and long lasting support and seal for the motor/pump assembly in the bottom of the dishwasher tank.

A need thus remains for an inexpensive motor/pump assembly mounting and supporting configuration for a domestic dishwashing machine which can be quickly attached and secured, which will maintain a substantially constant clamping force over the entire service life of the dishwashing machine, and which will automatically provide the proper force without requiring adjustment by the person doing the assembling.

SUMMARY OF THE INVENTION

Briefly, the present invention provides wire spring clamping members which are hooked onto posts on the top of the motor portion of the motor/pump assembly of the dishwasher. Before the springs are attached, the motor/pump assembly is inserted into the tank bottom from above until a gasketed flange on the pump portion of the assembly rests on the downwardly facing annular rim of a downwardly and inwardly curved surface provided in the tank bottom around the opening therein for the motor/pump assembly. The spring clamps are then placed on the motor/pump housing below the tank, and a hook portion on each of the spring clamps is hooked onto the respective housing posts. When in position, one end of the spring forms a substantially horizontally directed arm which extends from the hook to the edge of the rim for engaging the underside of the bottom of the tank. The other end of the spring forms a substantially curved portion extending away from the hook portion and curving downwardly around to end substantially beneath the hook portion and the post.

The end of the curved portion of the wire spring clamp beneath the clamp retainer post is a pivot on which is mounted a manually operable toggle member. The toggle member has a cam surface which is positioned opposite The motor housing, and, as the toggle member is rotated, engages the motor housing and pries the end of the spring clamp on which it is mounted away from the motor housing. The toggle member thus forms an operating mechanism or actuating means which moves the spring from an inoperable condition or position to an operable one. In the operable position the spring is pivoted about the post to compress its substantially horizontal arm against the bottom of the tank. This creates a substantially constant, predetermined, downward reaction force on the motor/pump assembly to pull the gasketed flange thereof against the annular rim in the sump opening. The gasketed flange serves as seat, and by this means, it and the motor/pump assembly are sealed and secured in substantially immovable relation in the bottom of the dishwasher tank.

The spring clamp will then automatically provide the desired force, as a function of its shape and design, without requiring adjustment in the dishwasher. The downward force applied by the spring will also be constant over many years, compensating for the initial rapid flow (yielding) of the elastomeric gasket, and subsequently and continuously compensating for later flowing, aging, and loss of resiliency, since the spring will maintain tension and take up any slack resulting therefrom. This is thus a substantial improvement over devices assembled with screws, since screws take longer to assemble, must be adjusted and tightened to a specific tension, and inherently will not provide the compensation which is automatically provided by the resilient spring clamps of the present invention.

The post and spring hook form a pivot for the spring. As a result, as the toggle operates against the vertical side wall of the motor, the opposite end of the spring operates against a substantially horizontal portion of the bottom of the dishwasher tank, the forces on the spring being pivoted through 99° about the post. Thus the surfaces which are engaged by the spring clamp (which includes the toggle) extend substantially at right angles to each other. Further, the toggle is provided with a flat or over-center cam on the raised end of the cam surface so that as it is rotated to the operative, force applying position against the vertical side wall of the motor, the flat engages the wall and holds the toggle in position.

If servicing should ever be required, the toggle can be quickly released, the spring clamp quickly removed, and the motor/pump assembly is then ready for removal for servicing. This is clearly much faster and easier than removing screws, and upon reassembly, the proper tension will again be automatically and quickly restored.

It is therefore an object of the present invention to provide a method and apparatus for assembling and securing a motor/pump assembly into a dishwashing machine; to provide a spring clamp member which can be engaged in compression between the motor/pump assembly and the bottom of the dishwasher tank to provide a constant, predetermined force therebetween for securing the motor/pump assembly in the dishwasher; which will secure the assembly with a substantially constant force over extended periods of time and will automatically compensate for loss of resiliency and elastomer flow in other portions of the assembly; which can be quickly and easily assembled; which provides the desired force without the need for adjustment during assembly; and which is uncomplicated, inexpensive, easy to fabricate, highly reliable, durable, and readily suited to mass production applications.

Other objects and advantages of the invention will be apparent from the following description, the accompanying drawings and the appended claims.

DESCRIPTION OF THE PREFERRED EMBODIMENT

Figure 1:
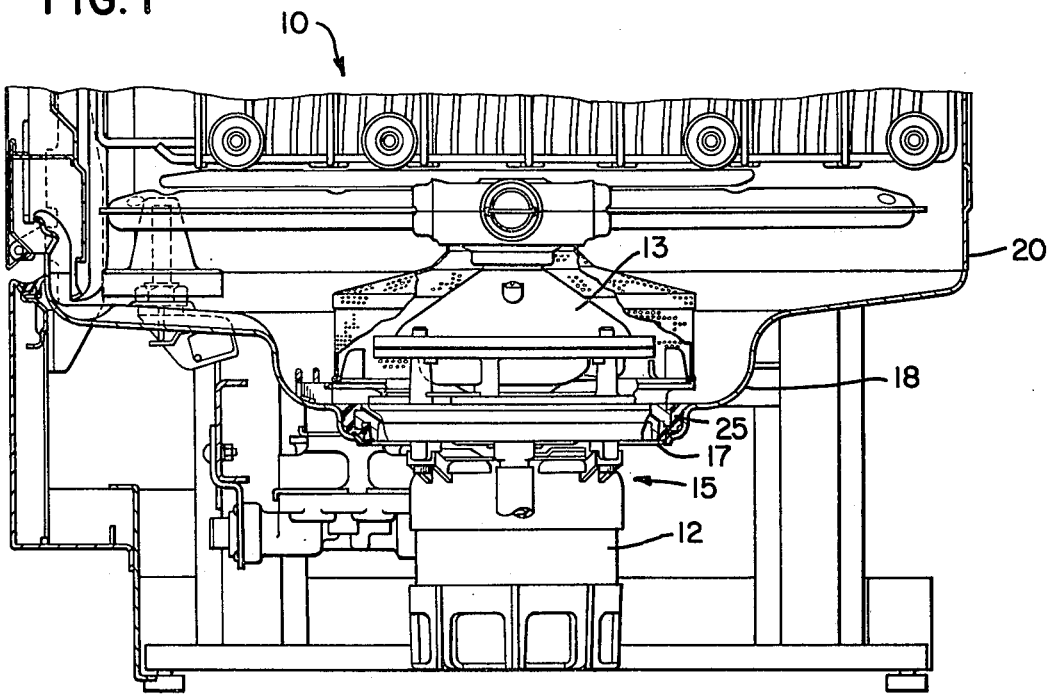
FIG. 1 is a partially broken away cross-sectional view of the lower part of a domestic dishwashing machine incorporating the present invention.

Dishwasher 10 illustrated in FIG. 1 includes a vertically aligned motor 12 and recirculating pump 13 secured to one another by screws 14 (FIG. 2) to form a motor/pump assembly referred to generally by reference numeral 15. These are secured in a circular opening 17 in the bottom of a sump 18 at the bottom of the dishwasher tank or wash chamber 20. Sump 18 is essentially cylindrical adjacent its bottom and contoured in vertical cross-section adjacent opening 17 to define a downwardly and inwardly curved surface 21 which merges with a downwardly-facing annular rim 22 which defines the opening 17 through the bottom of the sump 18.

The vertically aligned motor/pump assembly 15 is installed in an upstanding position, the motor body 12 being horizontally dimensioned smaller than the width of opening 17 to pass through the opening from above, that is, from within the dishwasher tank 20. Pump 13 has a flange or seat portion 24 of a dimension larger than opening 17, and an annular gasket 25 which is L-shaped in cross-section is carried on the outer edge of flange 24. When the motor/pump assembly 15 is then installed through opening 17, the annular gasket 25 and the flange 24 seat and seal against the downwardly and inwardly curved surface 21 in sump 18.

Figure 4:
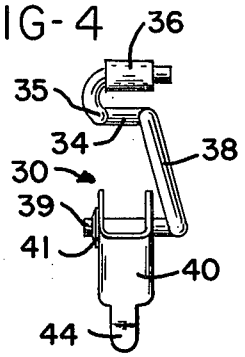
FIG. 4 is a view of the spring clamp as it would appear if freely suspended in a position similar to that shown in FIG. 6, looking in the direction of view line 4—4.
Figure 5:
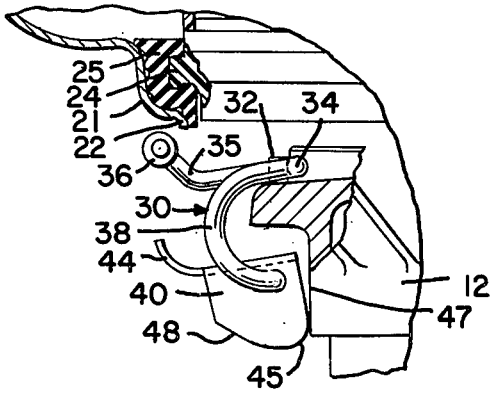
FIG. 5 is a partially sectioned fragmentary view of a portion of the FIG. 2 device, showing the clamp in the released or inoperative condition.

When the motor/pump assembly 15 is in this position, it is then secured by three independent and detachable wire spring clamps 30 which are removably mounted onto the motor/pump assembly 15 from below the tank 20. Pivot posts 32 on the top of motor 15 receive hook portions 34 on the wire spring clamps. When the hook portions 34 are first slipped over the posts 32, the clamps 30 appear as illustrated in FIG. 5. Each clamp 30 has a substantially horizontally extending arm 35 which is then located beneath the outer edge of the rim 22 of the sump opening 17. A resilient collar 36 on the end of arm 35 is then in position to engage rim 22. The other end of clamp 30 is a curved arm 38 which ends in a straight, horizontal portion forming a pivot shaft 39 for a manually operable toggle member 40 secured thereon by a lock washer 41 (FIG. 4).

Figure 2:
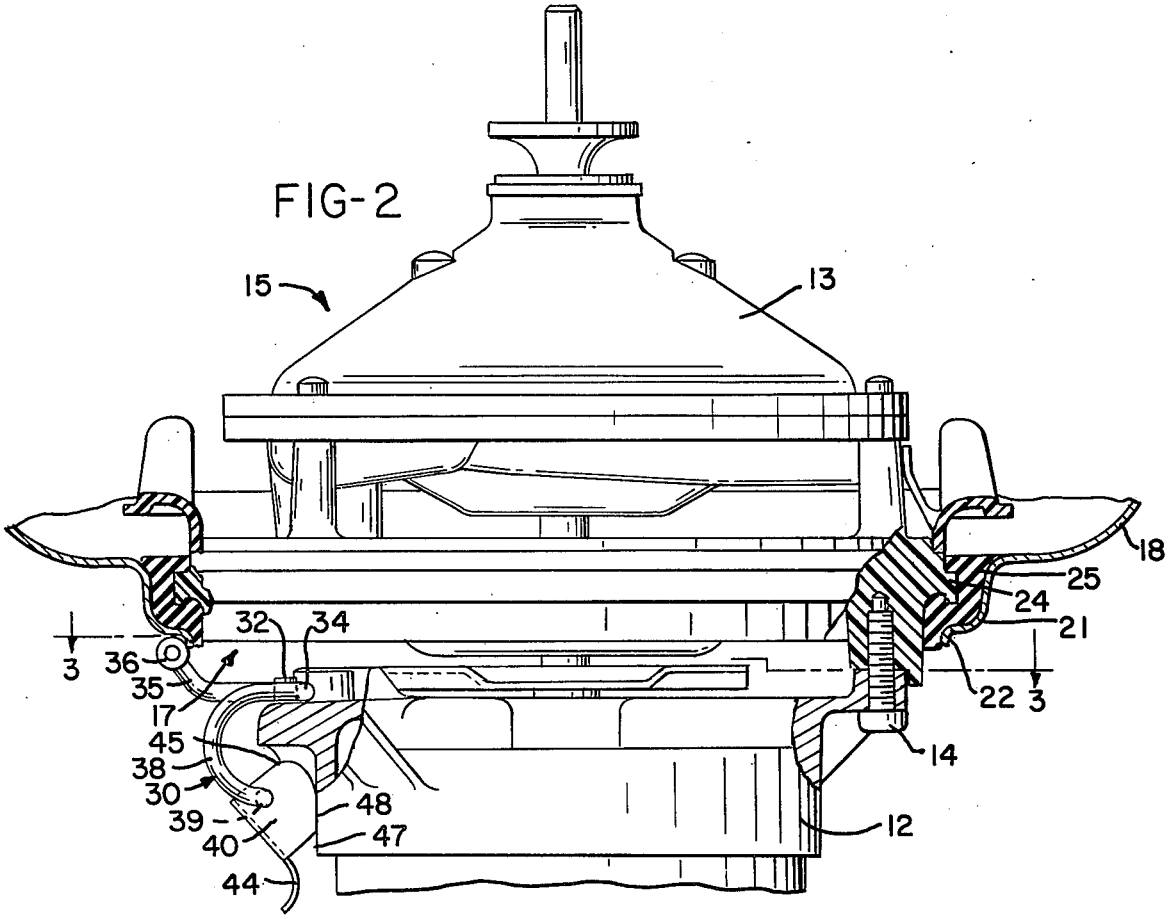
FIG. 2 is an enlarged, partially sectioned view of part of the FIG. 1 dishwasher, showing the motor/pump assembly mounted in the opening in the sump at the bottom of the dishwasher tank.
Figure 3:
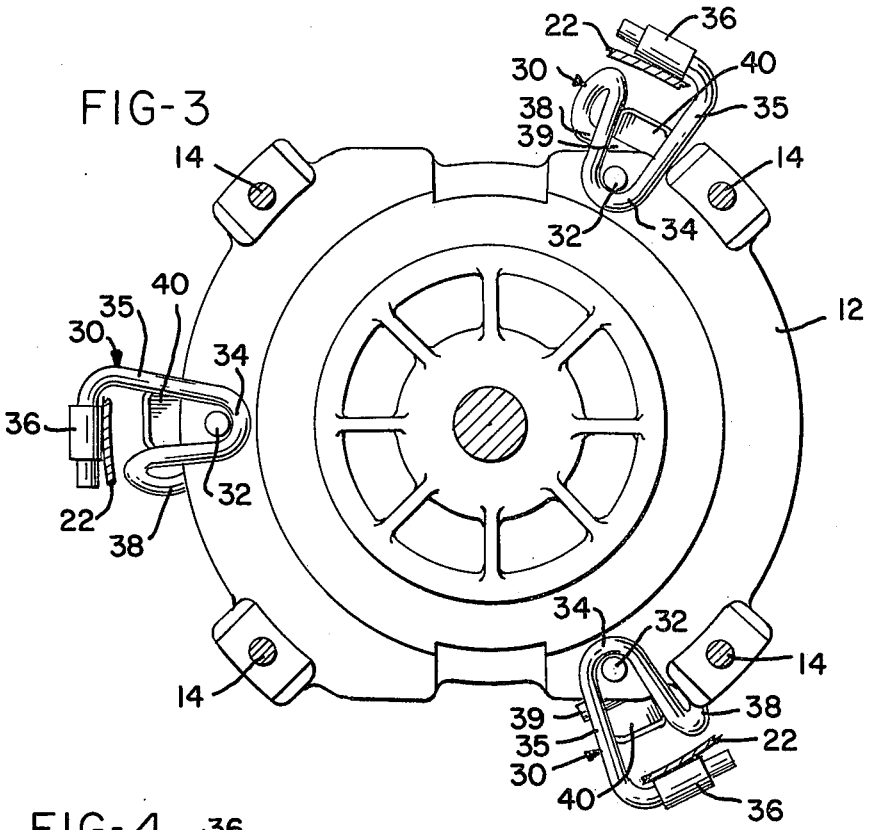
FIG. 3 is a partial view taken somewhat generally on view line 3—3 in FIG. 2.
Figure 6:
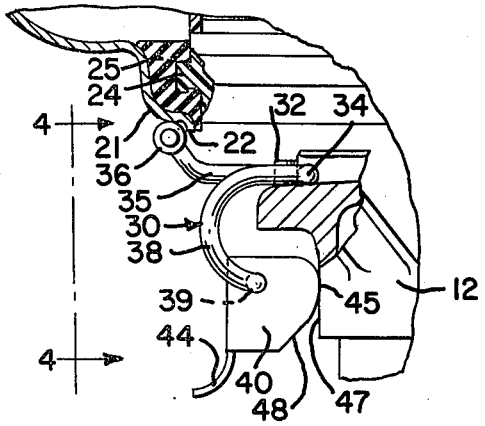
FIG. 6 is a view similar to FIG. 5, showing the toggle member rotated partially around onto the cam surface.

Toggle 40 has a finger tab 44 for rotating it on pivot shaft 39 to drive a cam surface 45 on toggle 40 against the vertical side wall 47 of motor 12. As this happens, the wire spring clamp 30, including its toggle member 40, is rotated about post 32 from the position illustrated in FIG. 5 to the position illustrated in FIG. 6. This forces the collar 36 on spring arm 35 upwardly against the bottom of the sump 18 at rim 22, which in turn generates a downward reaction force against the motor/pump assembly 15. Continued rotation of toggle 40 drives pivot end 39 of the spring clamp farther from the motor 12, and then brings a flat 48 on cam surface 45 against the motor side wall 47, as illustrated in FIG. 2, to lock the toggle in the FIG. 2 position. Each of the spring clamps 30 is then secured in operative condition for applying and maintaining a substantially constant downward force on the motor/pump assembly 15.

Since the forces applied by the wire spring clamps 39 are a function of the geometry of the sump 18, motor/pump assembly 15, and the spring clamps 30, the forces are therefore predetermined and will always be the same. No adjustment is possible in normal use, and none is required, either during or after assembly. Rather, after the motor/pump assembly 15 is inserted into sump opening 17, the clamps 30 are positioned beneath tank 20 and hooked onto the posts 32. The toggles are then quickly and easily rotated into the operative condition or position shown in FIG. 2. And, as indicated earlier, the spring clamps 30 are sufficiently resilient that flowing, aging, and relaxation of such parts as gasket 25 will automatically be accommodated within certain limits to maintain the desired clamping force.

The resiliency of the wire spring clamps 30 provides additional benefit in protecting the dishwasher 10 from possible damage from mishandling during shipment. If the dishwasher is dropped or otherwise abused, the wire spring clamps 30 will yield to extreme forces, reducing the likelihood of bending the sump 18 or cracking protective coatings thereon (such as porcelain). Screw type fasteners, in addition to requiring additional time to assemble and disassemble, will not as readily absorb such abuse.

As may be seen, therefore, the present invention provides numerous advantages. It is uncomplicated, inexpensive, and highly durable. It requires no adjustment, and can be quickly assembled and disassembled. The designed clamping force is automatically applied and is consistently maintained over extended periods of time. Assembly and subsequent servicing, if needed, are therefore greatly facilitated.

While the method herein described, and the form of apparatus for carrying this method into effect, constitutes preferred embodiments of this invention, it is to be understood that the invention is not limited to this precise method and form of apparatus, and that changes may be made in either without departing from the scope of the invention.

What is claimed is:

1. For use in a dishwasher for resiliently retaining a motor/pump assembly within the dishwashing tank, the bottom of the tank having an opening for receiving the motor/pump assembly therein, and the motor/pump assembly having a seat portion dimensioned to engage the sides of the tank opening to support the motor/pump assembly thereon, the improvement comprising:

a. at least one spring member having a hook portion along the length thereof, and b. a pivot post on the motor/pump assembly for receiving and retaining said spring member hook portion, said hook portion being dimensioned to fit around said post with said spring member below the tank and in compression between the bottom of the tank and the motor/pump assembly to place a substantially constant downward force on the motor/pump assembly to secure the seat portion thereof on the sides of the tank opening.

2. The device of claim 1 wherein said spring member further comprises a first arm extending from said hook portion for engaging the bottom of the tank, and a second arm extending from said hook portion for pressing against the motor/pump assembly.

3. The device of claim 2 further comprising a toggle member mounted on said second spring arm for engaging the motor/pump assembly, said toggle member being movable from a first position in which said toggle member engages the motor/pump assembly and places said spring member in compression against the bottom of the tank and said motor/pump assembly to provide said substantially constant force therebetween, said a second position in which said toggle member relieves the compression on said spring member.

4. The device of claim 3 wherein said toggle member is manually operable, is pivoted on the end of said arm, and includes a cam surface for engaging the motor/pump assembly and moving said second arm away therefrom as said toggle member is moved from said second position to said first position.

5. The device of claim 2 wherein said first arm is a substantially straight arm extending substantially horizontally from said hook portion when engaged with said post, and wherein said second arm is a substantially curved portion having an end substantially beneath said hook portion and said post when said hook portion is engaged therewith.

6. In a dishwasher having a tank defining a wash chamber, a sump at the bottom of the tank having an opening at its bottom, the sump being essentially cylindrical adjacent its bottom and contoured in vertical cross-section adjacent the opening to define a downwardly and inwardly curved surface adapted to be sealed by an annular gasket, the curved surface merging with a downwardly-facing annular rim defining the opening through the sump bottom, an upstanding motor/pump assembly at least a motor body of which is horizontally dimensioned to pass through the opening by installation from within the tank and to lie below the rim when mounted in operative position, the pump portion of the motor/pump assembly including a horizontally-extending flange larger than the sump opening for supporting the motor pump assembly on the downwardly and inwardly curved surface in the sump, an annular gasket of L-shaped cross-section, the gasket being carried by the flange at the outer edge thereof and being adapted, when the motor/pump assembly is placed in the sump, to provide a liquid-tight seal between the motor/pump assembly and the inwardly curved surface of the sump, the improvement comprising:

a. pivot posts on the motor body of the motor/pump assembly, b. a plurality of spring clamping members having hook portions removably mounted on said pivot posts from below the tank, which clamping members extend outwardly beyond and below the sump opening when so mounted, c. each said clamping member having a first arm extending from said hook portion and engageable with the outer edge of the sump rim, a second arm extending from said hook portion, and a manually operable toggle operating mechanism pivoted on the end of said second arm for compressing the spring means for applying simultaneous forces between the motor body and the rim acting to urge the motor/pump assembly and gasket into tight, substantially immovable reaction with the sump inner curved surface and to apply a constant force to the rim, d. said toggle member being movable from a first position in which said toggle member engages the motor body and places said spring member in compression against the bottom of the tank and said motor body and a second position in which said toggle member relieves the compression on said spring member, and e. said toggle member including a cam surface for engaging the motor/pump assembly and moving said second arm away therefrom as said toggle member is moved from said second position to said first position.

7. The device of claim 6 wherein said first arm is a substantially straight arm extending substantially horizontally from said hook portion when engaged with said post, and wherein said second arm is a substantially curved portion having an end substantially beneath said hook portion and said post when said hook portion is engaged therewith.

8. A spring clamp for directing substantially constant force against and substantially perpendicular to a pair of surfaces extending substantially at right angles to each other, comprising:

a clamp retainer providing a pivot point adjacent one of the surfaces, a wire spring having its opposite ends reacting against the surfaces, said spring comprising a hook portion engageable with said retainer, a second portion extending from said hook portion and directed to apply force substantially perpendicular to the one surface, and a third portion extending from said hook portion and directed to apply force substantially perpendicular to the other of the surfaces, and actuating means carried by said spring and operable between an inoperable condition in which said second and third spring portions are out of force applying contact with said surfaces and an operative condition placing said second and third portions in tension to cause the ends of said portions remote from said hook portion to simultaneously apply a predetermined force to each of the surfaces.

9. The device of claim 8 wherein said pivot point is a post.

10. The device of claim 8 wherein said spring further comprises a substantially straight first arm extending from said hook portion for engaging one of the surfaces, and a substantially curved second arm extending from said hook portion for pressing against the other surface.

11. The device of claim 10 further comprising a toggle member mounted on said second arm for engaging the other surface, said toggle member being movable from a first position in which said toggle member engages the other surface and places said spring member in compression between the pair of surfaces to provide said substantially constant force therebetween, and a second position in which said toggle member relieves the compression on said spring.

12. The device of claim 11 wherein said toggle member is manually operable, is pivoted on the end of said second arm, and includes a cam surface for engaging the other surface and moving said second arm away therefrom as said toggle member is moved from said second position to said first position.

* * * * *

UNITED STATES PATENT AND TRADEMARK OFFICE

CERTIFICATE OF CORRECTION

PATENT NO. : 4,060,346

DATED : November 29, 1977

INVENTOR(S) : Theodore F. Meyers

It is certified that error appears in the above-identified patent and that said Letters Patent are hereby corrected as shown below:

Col. 3, line 8, "99°" should be -- 90° --.

Col. 4, line 56 "clamps 39" should be -- clamps 30 --.

Col. 5, line 60 "said" (second occurrence) should be -- and --.

Col. 7, line 22 "inoperable" should be -- inoperative --.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*